United States Patent [19]

Keller

[11] 4,140,138

[45] Feb. 20, 1979

[54] SMOKING APPARATUS

[76] Inventor: Lawrence S. Keller, 2220½ Elba St., Durham, N.C. 27705

[21] Appl. No.: 817,998

[22] Filed: Jul. 22, 1977

[51] Int. Cl.[2] ..... A24F 1/14; A24F 1/30

[52] U.S. Cl. ..... 131/173; 131/194

[58] Field of Search ..... 131/173, 170 R, 171 R, 131/178, 194, 186, 198 R, 216, 223; D27/1-5

[56] References Cited

U.S. PATENT DOCUMENTS

| | | | |
|---|---|---|---|
| 3,804,100 | 4/1974 | Fariello | 131/173 |
| 3,863,648 | 2/1975 | Cathey | 131/186 |
| 3,936,048 | 2/1976 | Dunlap | D27/3 X |

*Primary Examiner*—Stephen C. Pellegrino
*Attorney, Agent, or Firm*—Mills & Coats

[57] ABSTRACT

The present invention relates to a smoking apparatus including a rotatably mounted liquid piston assembly that acts to pump air and resulting smoke through material being held or supported by the apparatus as the liquid piston assembly is manually turned in half turn intervals. The liquid piston assembly comprises two opposed compartments communicatively open with respect to each other in order that a liquid contained therein may move or gravitate from one compartment to the other as the respective compartments are rotated. After each half turn, liquid will gravitate from an upper oriented compartment to a lower oriented compartment and as the liquid gravitates a vacuum is created within the upper oriented compartment causing smoke to be pulled within that compartment. Further, the gravitating liquid will effectively force smoke received in the preceding half cycle from the lower oriented compartment through an exhaust valve associated with the liquid piston assembly. Thus, during each half turn or half cycle, one compartment is filled with smoke while the smoke already contained in the other compartment is exhausted.

22 Claims, 7 Drawing Figures

SMOKING APPARATUS

The present invention relates to devices for burning material and dispersing resulting smoke therefrom such as smoking appliances and incense burners wherein air is pumped through the material being burned by a mechanical power source.

BACKGROUND OF THE INVENTION

Smoking appliances and material burning devices such as incense burners are becoming more sophisticated and this sophistication has in many cases led to more effective and efficient products. For example, pipes are not being provided with mechanical means for pumping air and resulting smoke through the structure, such designs being of the type disclosed in U.S. Pat. No. 3,804,100; 3,863,648; and 3,889,690.

SUMMARY OF THE INVENTION

The present invention entails a smoking apparatus including a rotatable liquid piston assembly that acts to pump air and resulting smoke through the apparatus as the liquid piston assembly is rotated about an axis. Two opposed compartments form a part of the liquid piston assembly and a drain opening is provided through a divider wall separating the two compartments such that liquid contained in one compartment may move or gravitate to the other compartment through the drain opening.

In a preferred embodiment, the smoking apparatus comprises a pipe type structure including a bowl and a stem or passageway extending therefrom. Rotatively mounted about the stem or passageway area is the liquid piston assembly of the present invention with the same being partially filled with a liquid such as water. As the liquid piston assembly is rotated in half turn intervals, the liquid containing lower oriented compartment is moved to a position where it becomes the upper compartment, and the liquid contained therein, due to the force of gravity, will gravitate from that compartment to the then lower oriented opposed compartment.

The liquid piston assembly is designed such that the gravitation of the liquid results in a vacuum being created above the level of the liquid and in the upper oriented compartment. Provided as a part of the liquid piston assembly is means communicatively connecting the liquid piston assembly with the bowl such that the vacuum area acts to draw smoke from the bowl during the smoking operation and into the upper oriented compartment. During this time, the lower compartment is closed to the bowl, but is open for exhaust through an exhaust valve provided with the liquid piston assembly. As the liquid gravitates from the upper oriented compartment, the liquid displaces the smoke in the lower oriented compartment that was received therein during the preceding half cycle and by this displacement, the smoke is exhausted through the exhaust valve means from the liquid piston assembly. Consequently, it is appreciated that during each half turn or half cycle smoke is received within one compartment and exhausted from the other compartment. Therefore, during one complete revolution, smoke is received in one compartment and exhausted from that compartment.

It is, therefore, an object of the present invention to provide a device that can be used as a smoking apparatus or as an incense burner or the like which utilizes a water piston principle to effectively and efficienctly pump air and resulting smoke through the device.

A further object of the present invention is to provide a smoking apparatus of the character described and which utilizes a manually actuated mechanical air pumping device that mechanically pumps air and resulting smoke through the apparatus and the material being burned.

Still a further object of the present invention is to provide a smoking or burning apparatus that is adapted to burn various material such as tobacco, incense and the like wherein the resulting smoke is relatively cool and the resulting flavor and aroma genuinely reflects the quality of the material being burned.

Another object of the present invention is to provide a mechanical smoking apparatus that is relatively simple and inexpensive to manufacture, while being durable, efficient, and effective.

A further object of the present invention resides in the provision of a mechanical smoking apparatus that utilizes a manually actuated liquid or water piston to induce air into the smoking apparatus and to pump resulting smoke on through the apparatus.

In addition, a further object of the present invention resides in the provision of a smoking apparatus in the form of a pipe having said liquid or water piston assembly of the character described above associated therewith for effectively drawing air into the pipe bowl and through material being contained therein and for continuing to draw air and resulting smoke through the apparatus to where the smoke is exhausted therefrom.

Other objects and advantages of the present invention will become apparent from a study of the following description and the accompanying drawings which are merely illustrative of the present invention.

DESCRIPTION OF PREFERRED EMBODIMENT

Figure 1:
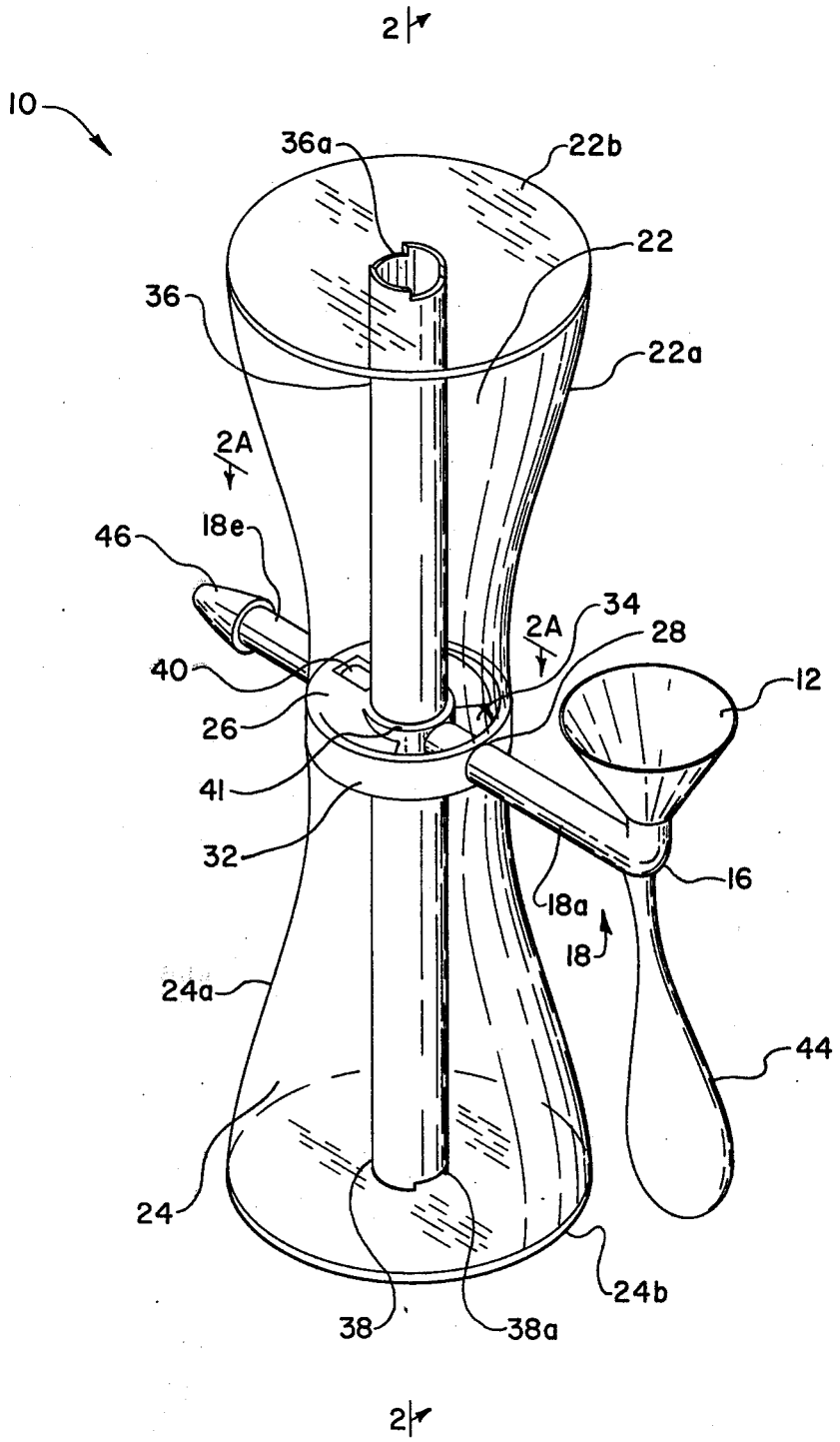
FIG. 1 is a perspective view of the smoking apparatus of the present invention.
Figure 2:
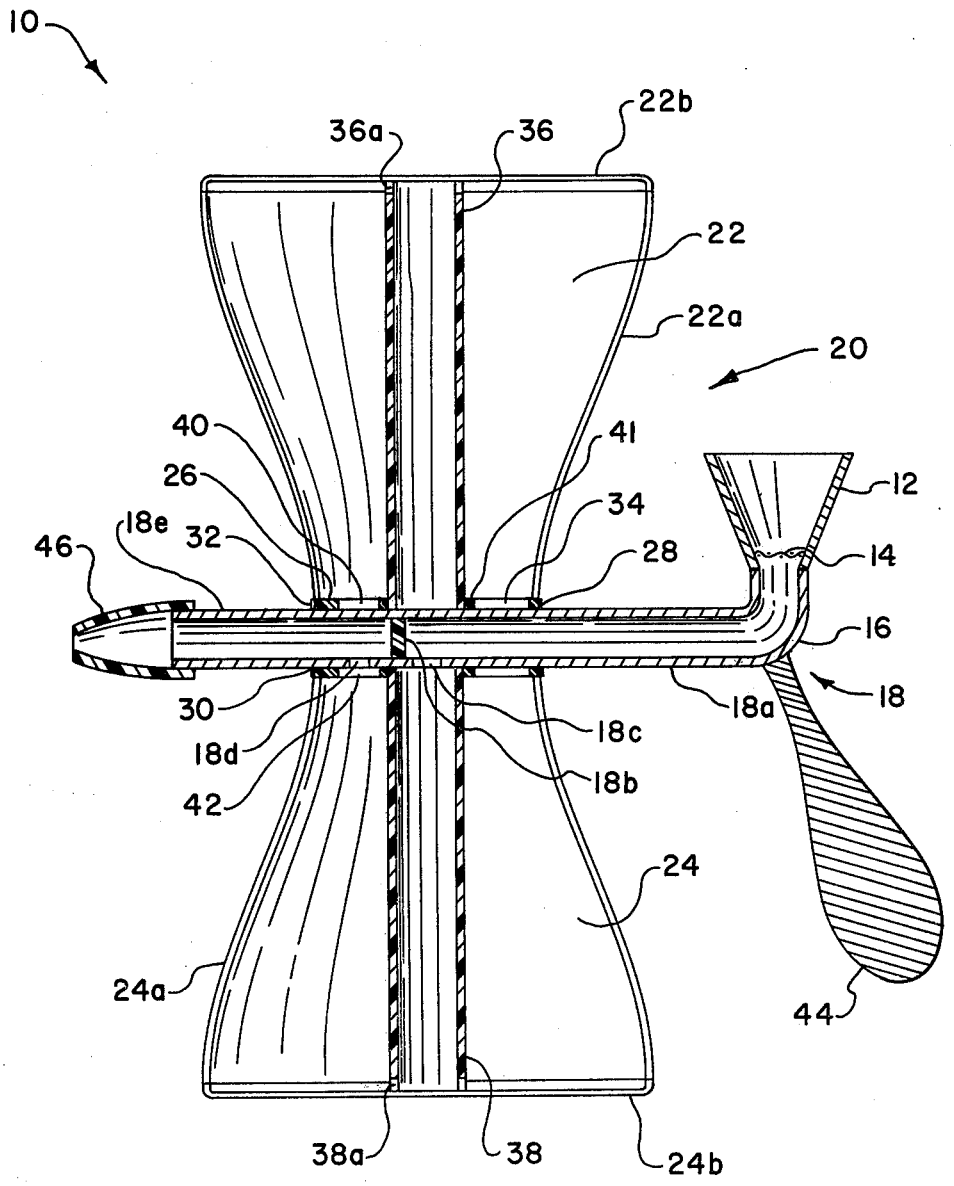
FIG. 2 is a vertical sectional view of the smoking apparatus taken along the lines 2—2 in FIG. 1.
Figure 2A:
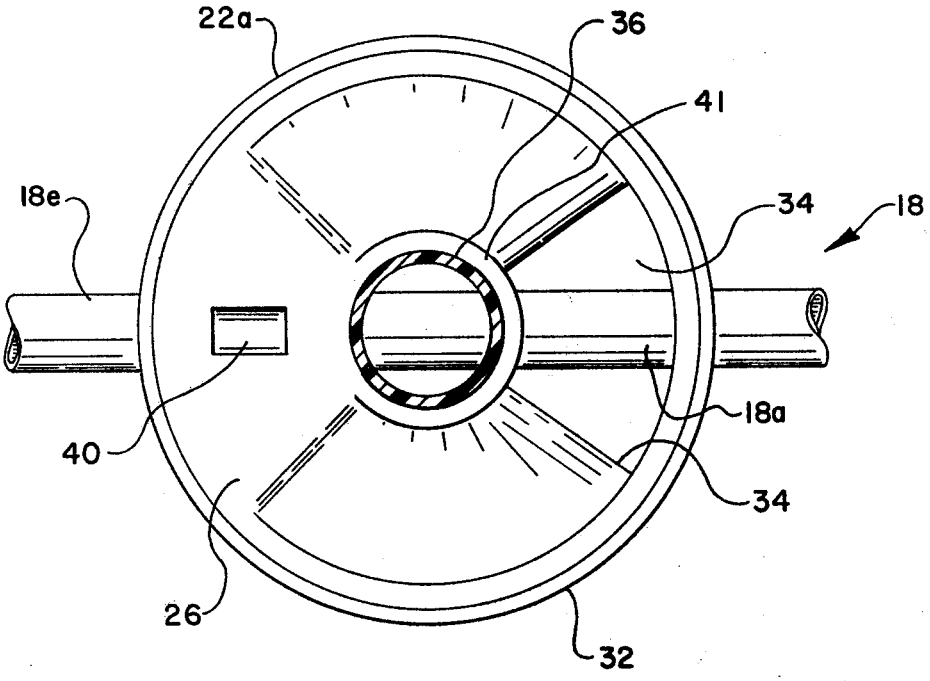
FIG. 2A is a horizontal sectional view of the smoking apparatus taken generally along the lines 2A—2A in FIG. 1.

With further reference to the drawings, particularly FIG. 1, the smoking apparatus or device for burning material and dispersing smoke therefrom is shown therein and indicated generally by the numeral 10.

Smoking apparatus 10 comprises means for holding or supporting material to be burned and in the preferred embodiment disclosed herein such supporting or holding means includes a pipe bowl 12 of a generally conical shape supported above an elbow 16 that generally communicatively connects bowl 12 with an elongated cylindrical stem or passageway indicated generally by the numeral 18. A screen 14 is secured transversely across the lower portion of the bowl 12 in order to support material to be burned within the bowl. Therefore, it is appreciated that in the preferred embodiment shown that the smoking apparatus is of the pipe type, but it is understood that other means may be used to support material to be burned by the apparatus of the present invention.

Rotatively mounted intermediately about stem or passageway 18, is a liquid piston assembly 20 that, as will be understood for subsequent portions of this disclosure, acts to pump air and resulting smoke through the smoke apparatus 10 of the present invention in response to the liquid piston assembly being manually rotated about the axis of said stem or passageway 18.

Viewing liquid piston assembly 20 in detail, it is seen that the same includes a chamber or bottle type closure that includes two compartments 22 and 24 disposed about opposite sides of a divider wall or partition 26. Compartments 22 and 24 are preferably transparent and may be constructed of glass, plastic or the like and include an outer wall structure **22*a* and 24*a*, and outer ends 22*b* and 24. Each outer end 22*b* and 24*b* may be adapted to be screwed on and off each respective compartment in order to fill the chamber, which is essentially made up of the two compartments, with a liquid such as water. It will be understood, however, that the same compartments 22 and 24 could be provided with threads about the neck areas thereof such that each compartment could be screwed to the divider wall or partition 26**.

Divider wall or partition 26 is disposed generally midway between the two compartments 22 and 24 and about the outer edge the divider wall includes a generally arcuate shaped band 32. Formed about the band 32 is an inlet bore 28 and an outlet bore 30, both being aligned for receiving stem or passageway 18. The divider wall or partition 26 and the stem or passageway 18 is designed such that there exists a relatively tight fit between the two with the fit being sufficiently loose to allow the divider wall 26 and the entire liquid piston assembly 20 to be rotated about an axis of the stem or passageway 18.

Provided within the divider wall or partition 26 is a drain opening means 34 that allows liquid to pass through the divider wall 26 and to and from compartments 22 and 24.

A pair of intake conduits or tubes 36 and 38 are rotatively mounted about the stem or passageway 18 with each intake conduit or tube extending radially from the stem 18 towards the outer end **22*b* or 24*b* of a respective compartment 22 or 24. For supporting and retaining the intake conduits or tubes in the preferred embodiment, there is provided a collar 41 that is integrally constructed with the divider wall 26 or supported and retained thereby with the collar being rotatively journaled about the exterior of the stem or passageway about an intermediate area thereof. Collar 41, although rotatively journaled about the exterior of the stem 18, is on a greater cross sectional area than the stem or passageway 18 so as to define a passing area between the inside of the collar and the exterior of the stem or passageway 18. The importance of this passing area will become apparent in subsequent portions of the disclosure because it will be seen that in the preferred embodiment both smoke and water will need to pass between the inside of the collar 41 and the exterior of the stem or passageway 18. It is thusly seen from the drawings that the intake conduits or tubes 36 and 38 communicatively join the collar 41 about the area adjacent the stem 18 and that the collar 41 and the intake conduits 36 and 38 are constrained to rotate with the divider wall 26 and the entire liquid piston assembly 20 when the same is manually rotated. The intake conduits 36 and 38 extend to where the outer ends thereof terminate closely adjacent the ends 22*b* and 24*b* of the respective compartments 22 and 24. To allow smoke to escape from the conduits 36 and 38 into respective compartments 22 and 24, each conduit is provided with an outlet end port or opening 36*a* and 38*a***.

With particular reference to the stem or passageway 18, it is seen from the drawings that the same includes a generally elongated hollow tubular member including a smoking inlet segment **18*a* that leads from the elbow through a portion of the divider wall 26 to an intermediate area where a stop 18*b* extends across the stem so as to block the flow of smoke therepass. Formed within the smoke inlet segment 18*a* is a smoke inlet opening 18*c* that is particularly formed about the lower side of the stem and wherein this smoke inlet opening is particularly positioned with respect to the liquid piston assembly 20 such that the collar 41 and the intake conduits 36 and 38 rotate about the area of the stem 18 where the smoke inlet opening 18*c* is positioned. It is seen from the drawings that smoke exiting through the smoke inlet opening 18*c* can move up and around the area between the inside of the collar 41 and the exterior of the stem 18 and on through either intake conduit 36 or 38**.

Formed on the opposite side of the stop **18*b* from the smoke inlet opening 18*c* is an exhaust opening 18*d*, and this opening is particularly positioned about the lower side of the stem 18. An exhaust valve is formed by the provision of divider wall exhaust ports 40 and 42 on each side of the divider wall 26 with the exhaust ports 40 and 42 being aligned with the exhaust opening 18*d* formed in the stem or passageway 18. A relatively tight fit is provided between the exterior of the stem or passageway 18 and the wall structure about the exhaust ports 40 and 42 of the divider wall 26 such that the exhaust opening 18*d* is closed to the opposite exhaust port 40 or 42 when either assumes an upper position opposite the exhaust opening 18*d***.

The final portion of the stem or passageway 18 is that portion that extends from the stop **18*b* pass the exhaust opening 18*d* and on through the chamber or liquid piston assembly 20, and this portion is referred to as an exhaust section 18*e*. Secured to the terminal end of the exhaust section 18*e* is a dispersing nozzle 46 for dispersing exhausted smoke from the apparatus 10** of the present invention.

The apparatus 10 of the present invention is provided with a handle 44 that in the case of the preferred embodiment extends downwardly from the stem area adjacent the elbow, and the handle may preferably be weighted so as to help stablize the bowl 12 in an upright position during operation.

Figure 3:
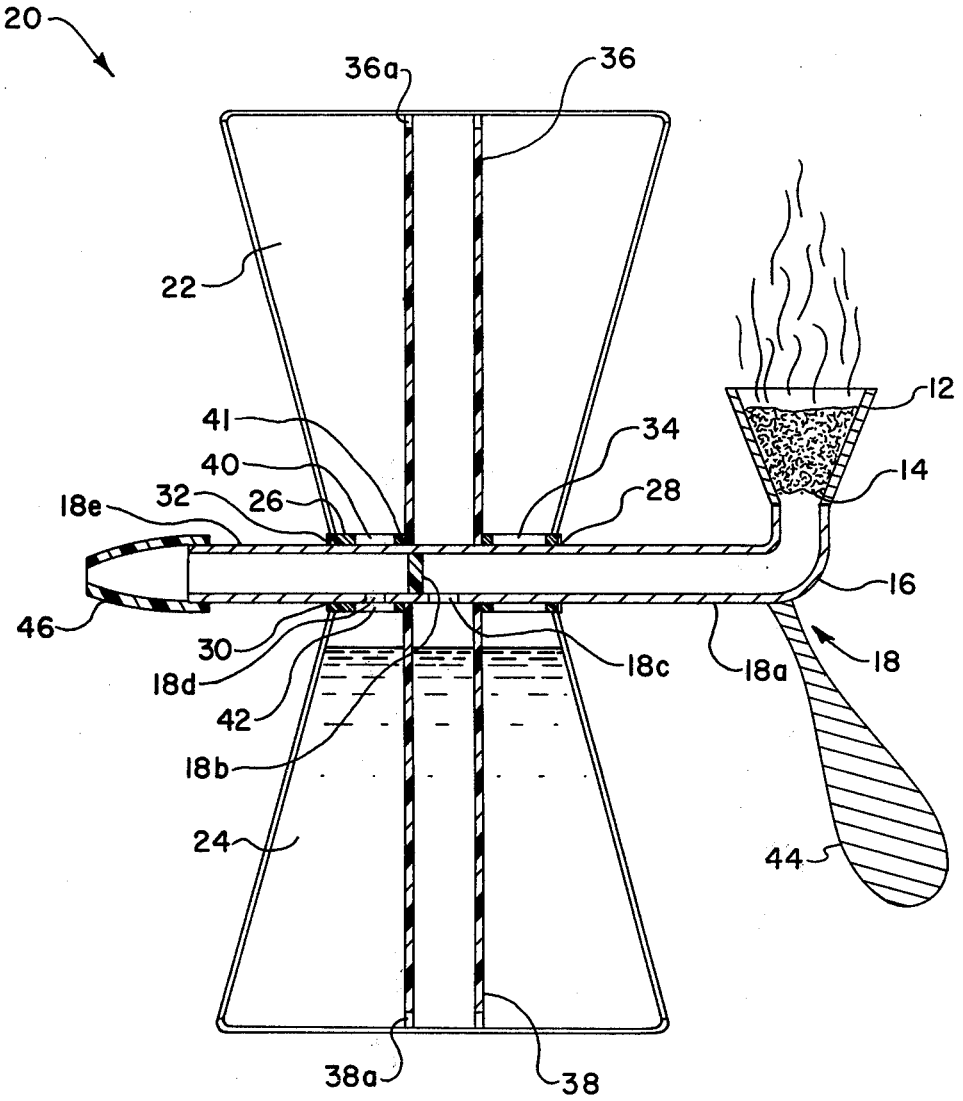
FIGS. 3-6 are a series of sequence views illustrating the basic operation of the smoking apparatus of the present invention.
Figure 4:
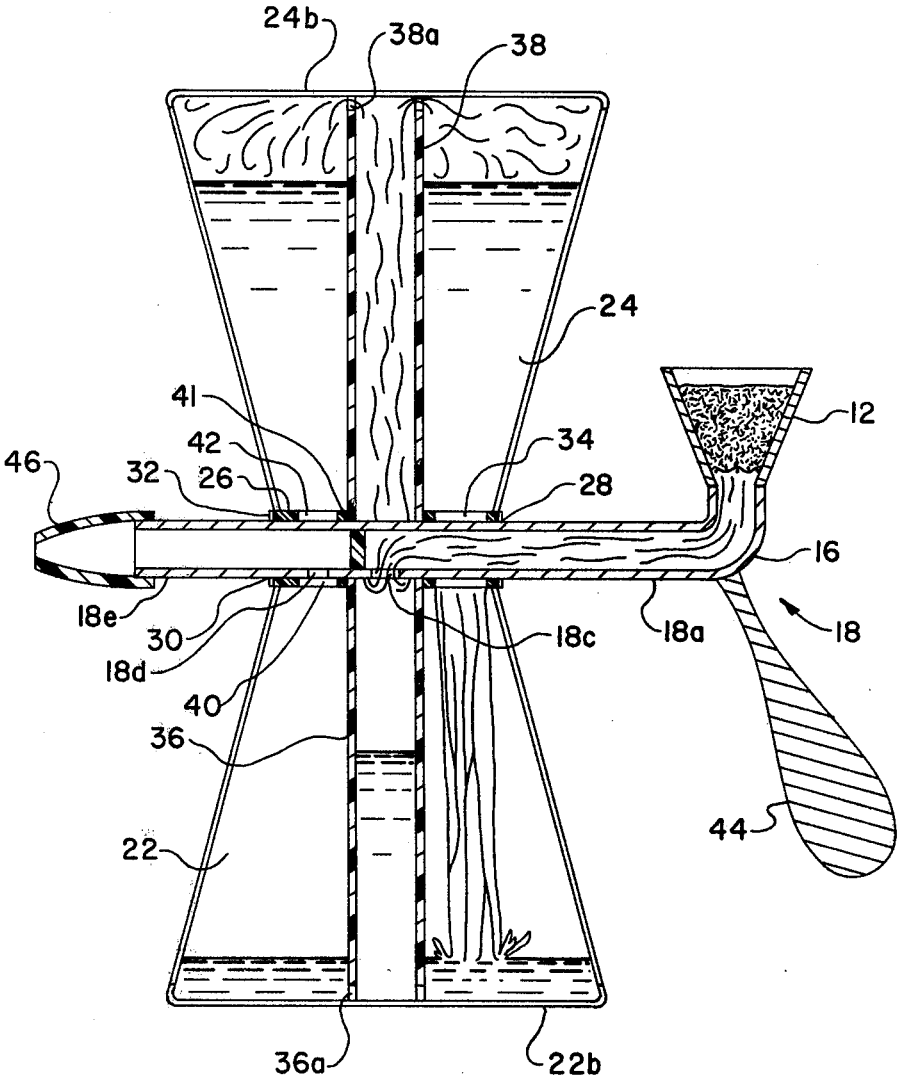

FIGS. 3 through 6 illustrate the operation of the smoking apparatus 10 of the present invention. In this regard, it is noted as shown in FIG. 3 that a volume of liquid such as water is shown contained in the lower compartment 24 and the material within bowl 12 is burning. By grasping handle 44 the liquid piston assembly can be rotated one-half turn or 180 degrees by rotating the chamber or the two compartments about the longitudinal axis of the stem 18 to where compartment 22 occupies a lower oriented position and compartment 24 now occupies an upper oriented position, as seen in FIG. 4. Once this half-turn rotation has occurred, it is seen that the liquid or water is now positioned above the stem 18 and includes potential energy. The liquid or water begins to gravitate through drain opening 34 within the divider wall 26 from the upper compartment 24 to the lower compartment 22. Also, some liquid or water in the intake conduit 38, as shown in FIG. 3, may drain directly downwardly therethrough and on through the intake conduit 36, and this liquid or water may combine with the initial water passing through the drain opening 34 to seal the area between the terminal end of the intake conduit 36 and the outer end 22*b* of the then lower oriented compartment 22, as illustrated in FIG. 4. Consequently, the liquid or water surrounding the outer remote end of the intake conduit 36 acts as a valve to close the intake conduit 36 from the other portions of the apparatus 10.

Continuing to refer to the smoking apparatus 10 as seen in FIG. 4, it is seen that the upper portion of compartment 24 above the level of the liquid is closed to the exhaust opening 18*d* in the stem 18 and is closed to the lower compartment 22 by the presence of the water or liquid around the lower terminal end of the intake conduit 36. But the upper area of compartment 24 above the level of the water is open to the smoke inlet opening 18*c* through the port 38*a* formed about the outer terminal end of the intake conduit 38. The gravitation of the liquid or water from compartment 24 into compartment 22 creates a vacuum in the upper area of compartment 24 above the liquid level and this vacuum induces air into and through the bowl 12 resulting in smoke moving through the smoke inlet segments 18*a*, through the smoke inlet opening 18*c*, up the intake conduit 38 and out the ports or terminal end 38*a* into the vacuum area created. As the liquid or water continues to drain, the vacuum created will cause the entire upper oriented compartment 24 to be filled with smoke from the burning material and this is illustrated in FIG. 5 and shows compartment 24 being filled with smoke while the liquid or water now is held by the lower oriented compartment 22.

Figure 5:
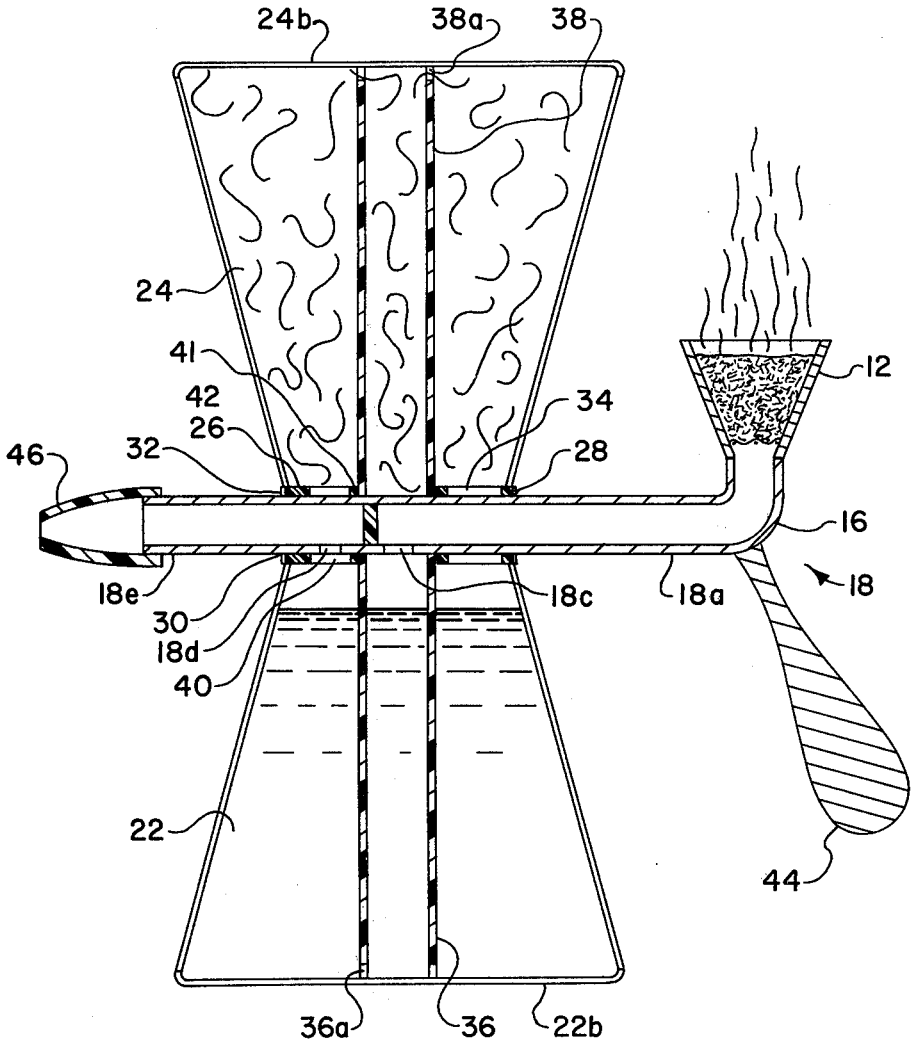
Figure 6:
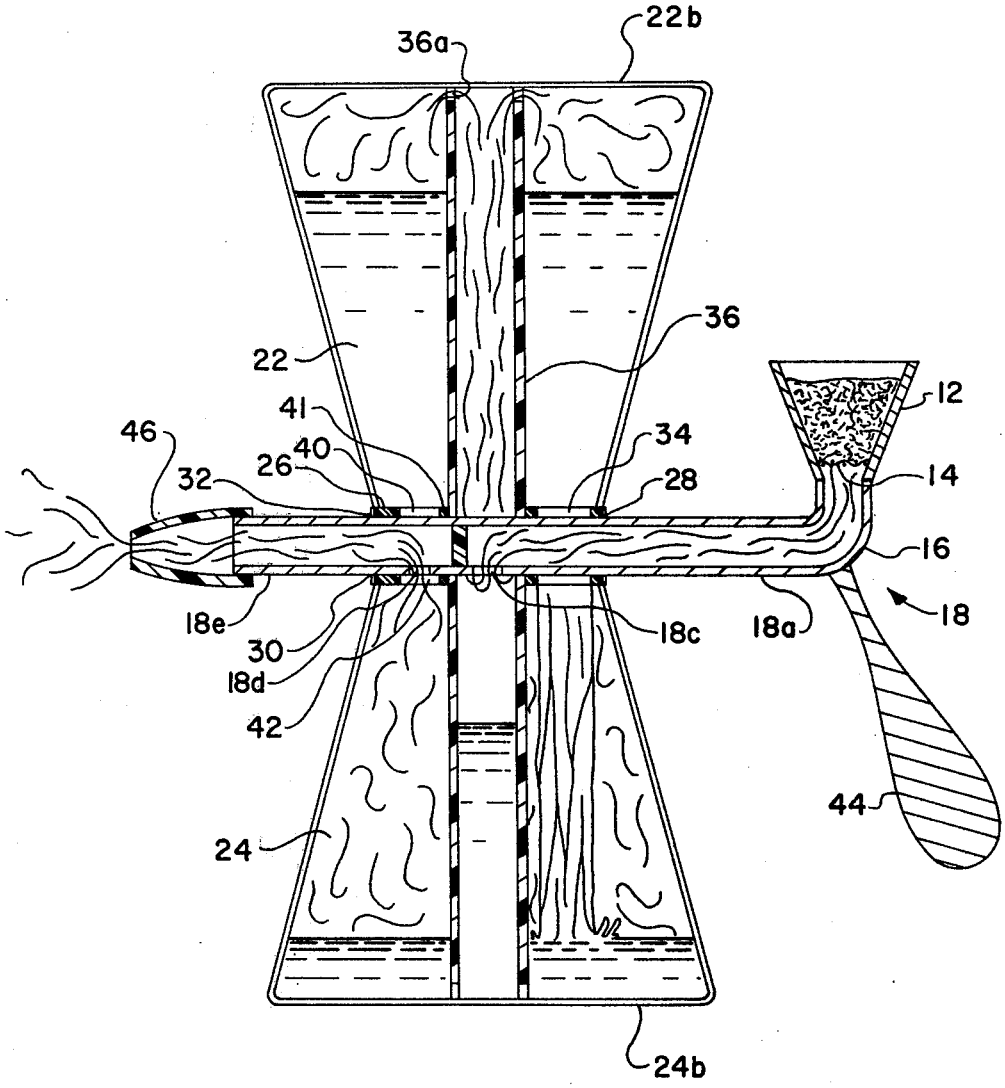

From the state illustrated in FIG. 5, the liquid piston assembly 20 is once again rotated one-half turn or 180 degrees where compartment 24 now assumes a lower oriented position and compartment 22 assumes an upper oriented position. Just as previously described with respect to compartment 24, compartment 22 as oriented in FIG. 6 now is filled with smoke due to the vacuum created by the gravitating water that gravitates through drain 34 to the then lower compartment 24. But not and in future cases in the continuing operation of the smoking apparatus 10, the lower compartment contains a volume of smoke and this smoke is exhausted from compartment 24 through exhaust port 42 formed in the lower side of the divider wall 26 and through the aligned exhaust opening 18*d* formed in the exhaust segment 18*e* of the stem. This exhaust is caused and is responsive to the gravitating water or liquid which moves downwardly through the drain 34 and effectively displaces the smoke in the lower oriented compartment 24. Once the smoke has reached the exhaust segment 18*e*, then the stop 18*b* prohibits the smoke from moving left to right, as viewed in FIG. 6, and consequently the smoke must be exhausted right to left, as viewed in FIG. 6, through the exhaust segment 18*e* and the nozzle 46. It is seen that the initial presence of liquid or water about the lower terminal end of the intake conduit 38 prohibits the smoke in compartment 24 from moving back through the intake conduit 38 into the upper vacuum area of the upper compartment 22.

It is thusly appreciated that each half cycle or half turn of the liquid piston assembly 20 causes smoke to be drawn into the upper vacuum area of an upper oriented compartment and at the same time results in smoke in a lower oriented compartment to be exhausted. Consequently, one revolution of the liquid piston assembly results in smoke being drawn within a particular compartment during the first half cycle or half turn and that the same smoke being exhausted from the same compartment during the second half turn or half cycle.

From the foregoing specification, it is seen that the apparatus of the present invention provides an efficient and effective means for smoking or for dispersing smoke from material being burned. It should be pointed out that while the present invention can function as a smoking apparatus, the title of the present invention "Smoking Apparatus" has been used herein for the purpose of reference and it is to be understood that this apparatus can be utilized as a burning apparatus and smoke dispersing device that could be used to burn incense or the like. Also, it will be appreciated that the invention could be of various sizes and shapes without departing from the present invention. It is recognized that the chamber or compartments can have a capacity of approximately 14 to 16 fluid ounces and work efficiently. The various openings and valves can be particularly sized to provide a desired exhaust flow of smoke.

The terms "upper," "lower," "forward," "rearward," etc., have been used herein merely for the convenience of the foregoing specification and in the appended claims to described the smoking apparatus and its parts as oriented in the drawings. It is to be understood, however, that these terms are in no way limiting to the invention since the smoking apparatus may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A smoking apparatus comprising: a pipe assembly having a bowl and a stem leading from said bowl such that in the smoking process air may enter the bowl and move through burning material contained therein and into said stem; and a liquid piston assembly rotatively mounted about said stem for pulling air through said bowl and exhausting resulting smoke in response to said liquid piston assembly being rotated about said stem, and wherein said stem includes an inlet smoke opening formed therein at a position within said liquid piston assembly; said liquid piston assembly including a chamber adapted to contain a volume of liquid less than the total capacity of the chamber and drain means intermediately disposed with respect to said chamber for allowing liquid to drain therethrough, wherein as the chamber is rotated the volume of liquid after each revolution first assumes a generally top elevated position within said chamber and gravitates through said drain means to the lower area thereof due to the influence of gravity, the movement of the liquid from the top elevated position within the chamber to the lower area thereof resulting in a suction area about the upper portion of the chamber that induces inlet air through said bowl and draws resulting smoke into the upper area of the chamber via said inlet smoke opening, and wherein the downward movement of the liquid forces smoke disposed then in the lower area of the chamber, that was received therein during the previous revolution out of the chamber, through an exhaust opening disposed in the vicinity of the axis of rotation of said liquid piston assembly such that during each revolution of the chamber a volume of smoke is received within the chamber and the previous volume of smoke received during the preceding revolution it exhausted from the chamber.

2. The smoking apparatus of claim 1 wherein said inlet smoke opening is communicatively associated with a smoke intake conduit that is fixed relative to said chamber and rotatable therewith such that air moving through said inlet smoke opening may be channeled through said smoke intake conduit to an upper suction area of said chamber after each revolution thereof, the smoke intake conduit extending towards opposite ends of said chamber from said inlet smoke opening where the smoke intake conduit includes opposite terminal ends disposed in close proximity to the respective ends of said chamber such that air may freely move from the terminal ends into a top vacuum portion of the chamber during the smoke intake cycle of each revolution and wherein the liquid in the lower portion of the chamber acts as a valve to prohibit air from the lower portion of the chamber from being pulled through the smoke intake conduit to the upper vacuum air space.

3. The smoking apparatus of claim 2 wherein said exhaust opening forms a part of an exhaust valve that opens the lower disposed portion of said chamber to exhaust smoke contained therein during each revolution of said liquid piston assembly.

4. The smoking apparatus of claim 3 wherein said chamber includes two compartments of generally equal volumes separated by a divider wall having said drain means in the form of at least one drain opening formed therethrough that allows liquid to move from one compartment to the other after each half turn of the chamber.

5. The smoking apparatus of claim 4 wherein said stem is rotatively journaled in said divider wall, and wherein said stem includes a stop down stream from said inlet smoke opening to prevent smoke from being directly exhausted through said stem; and wherein said exhaust valve is formed down stream from said stop.

6. The smoking apparatus of claim 5 wherein said chamber is of greater diameter about the opposite end portions than the intermediate areas about said divider wall.

7. A smoking apparatus comprising: holding means for holding material to be burned and including a stem; a chamber rotatively mounted adjacent said stem and including two compartments generally separated by a divider wall having drain means formed therein and wherein said chamber is normally oriented vertically with one compartment being disposed over the other and wherein said chamber is adapted to contain a volume of liquid that moves from one compartment to the other through said drain means in response to rotating the chamber one-half turn; smoke inlet means formed in said stem and open to said chamber for directing smoke from said stem and the material being burned to said chamber, said smoke inlet means including means for routing smoke through an upper disposed compartment as the liquid within said chamber moves from the upper oriented compartment to the lower oriented compartment after each half turn, the falling liquid creating a vacuum space above the falling liquid in the upper compartment that draws air through the material being burned and the resulting smoke through the smoke inlet means into the upper disposed compartment; and exhaust valve means operatively associated with said chamber for normally maintaining the upper oriented compartment closed to exhaust and for maintaining the lower disposed compartment open to exhaust such that the falling liquid moving from the upper compartment to the lower compartment after each half turn forces the smoke contained in the lower compartment out of said chamber via said exhaust valve means.

8. The smoking apparatus of claim 7 wherein said smoke inlet means and the means thereof for routing smoke to an upper disposed compartment comprises: a passageway leading from said holding means into said chamber; an opening formed in said passageway internally of said chamber; and a pair of intake conduits communicatively connected with said opening and extending therefrom towards opposite ends of the two respective compartments with each intake conduit having a smoke outlet port that terminates relatively close to an end wall of a respective compartment of said chamber.

9. The smoking apparatus of claim 8 wherein said exhaust valve means includes an opening formed in an exhaust conduit extending through a portion of said divider wall and from said chamber with said opening being oriented about a bottom side of said exhaust conduit; and exhaust port means formed in said divider wall for each compartment of said chamber with the exhaust ports being aligned such that the exhaust port for each compartment aligns with the opening in said exhaust conduit when each respective compartment assumes the lower oriented position.

10. The smoking apparatus of claim 9 wherein said exhaust conduit and said passageway of said smoke inlet means leading from said holding means into said chamber form one common cylindrical member that is journaled within said divider wall, and wherein there is provided stop means within said cylindrical member between said opening formed in said passageway of said smoke inlet means and the opening of said exhaust valve means formed in said exhaust conduit for prohibiting smoke from passing directly through said cylindrical member.

11. The smoking apparatus of claim 10 wherein said pair of intake conduits are rotatively mounted about said cylindrical member and extend radially therefrom outwardly of opposite sides of said divider wall such that as said chamber is rotated about said cylindrical member said conduits rotate with the chamber.

12. The smoking apparatus of claim 11 wherein said divider wall is provided with a cylindrical bore extending through the same, with said cylindrical bore having an inlet opening about one end of said divider wall and an outlet opening about the other end of said divider wall.

13. The smoking apparatus of claim 12 wherein said liquid piston assembly comprises an hour glass shaped chamber.

14. An apparatus comprising: holding means for holding material to be burned; a rotatively mounted liquid piston assembly operatively associated with said material holding means for pumping air through said holding means and any material being held thereby; said rotatively mounted liquid piston assembly having two compartments communicatively open to each other by the provision of drain means disposed generally intermediately therebetween in order that liquid contained in either compartment may be transferred to the other by rotating said liquid piston assembly in one-half turn intervals where liquid may be transferred from a lower oriented compartment through said drain means to the other by rotating the lower oriented compartment to a position where that same compartment becomes an upper oriented compartment, whereupon once in the upper oriented position liquid contained therein will be caused to gravitate through said drain means to the other then lower oriented compartment; said liquid piston assembly including means projecting from said holding means into said respective chambers for directing air and any resulting smoke through said holding means into an upper oriented compartment in response to the liquid in that upper oriented compartment gravitating downwardly to the oppositely disposed lower oriented compartment; and wherein said liquid piston assembly further includes exhaust means operatively associated with each chamber for exhausting smoke from a lower oriented compartment in response to the liquid gravitating from an upper oriented compartment to the smoke containing lower oriented compartment after each half revolution of said liquid piston assembly.

15. The smoking apparatus of claim 14 wherein said liquid piston assembly having said two compartments communicatively connected with respect to each other in order that liquid may flow from one to the other further comprises:

(a) a divider wall extending between said two compartments generally midway between opposite outer ends of said two compartments with said divider wall having a drain opening formed therein such that liquid contained in one compartment may move through said drain opening to the other compartment; and (b) wherein said means for directing air and/or smoke into the upper oriented compartment during operation includes:

(b1) a passageway leading from said holding means into said liquid piston assembly;

(b2) opening means formed in said passageway for allowing air and/or smoke to pass from said passageway therethrough; and (b3) a pair of intake conduits communicatively connected about said opening means formed in said passageway and each intake conduit extending from said opening means towards an outer end of a respective compartment with each intake conduit having an exiting port that terminates closely adjacent a respective outer end, whereby smoke and/or air being pulled through said holding means may move through said passageway, through said opening means formed therein, and into a respective compartment via one of said intake conduits.

16. The apparatus of claim 15 wherein said liquid piston assembly and the two compartments thereof are rotatively journaled about said passageway with said passageway extending through said divider wall with the axis of said passageway being generally perpendicular to the axis of said intake conduits; and wherein said exhaust means is formed by said passageway with a second exhaust opening formed therein in cooperation with said divider wall such that the second exhaust opening formed in said passageway is open for exhaust to the lower oriented compartment during the operation of said apparatus.

17. The apparatus of claim 16 wherein blocking means is provided within said passageway between said first smoke inlet opening and said second exhaust opening to prevent inlet smoke being drawn through the holding means from being directly exhausted without first being channeled into one of said compartments.

18. The apparatus of claim 17 wherein said intake conduits extending internally within each compartment are axially aligned and rotatable with said liquid piston assembly about the longitudinal axis of said passageway.

19. The apparatus of claim 18 wherein said passageway extends completely through said liquid piston assembly and includes an exhaust end having a nozzle secured thereon for dispersing exhausted air or smoke from said liquid piston assembly.

20. The apparatus of claim 19 wherein said liquid piston assembly and said two compartments thereof form a structure of a generally hour glass shape with the opposite ends thereof having a greater cross-sectional area than the cross sectional area intermediate thereof.

21. The apparatus of claim 20 wherein said holding means includes a pipe bowl communicatively connected with said passageway; and wherein there is provided a handle means that extends from an area adjacent said bowl downwardly therefrom such that the entire apparatus can be supported by said handle and said liquid piston assembly can be rotatively turned about the axis of said passageway.

22. The apparatus of claim 21 wherein said handle means is weighted.

* * * * *